United States Patent [19]

Sato

[11] 4,018,157

[45] Apr. 19, 1977

[54] PRINTING HEAD FOR PRINTING BAR CODE CHARACTERS

[75] Inventor: Yo Sato, Tokyo, Japan

[73] Assignee: Kabushiki Kaisha Sato Kenkyusho, Tokyo, Japan

[22] Filed: Apr. 21, 1976

[21] Appl. No.: 678,761

[30] Foreign Application Priority Data

Apr. 26, 1975 Japan ..... 50-50221
Sept. 11, 1975 Japan ..... 50-109474

[52] U.S. Cl. ..... 101/110; 101/106
[51] Int. Cl.[2] ..... B41J 1/60
[58] Field of Search ..... 101/95–111; 235/58 P, 60 P

[56] References Cited

UNITED STATES PATENTS

| | | | |
|---|---|---|---|
| 3,269,306 | 8/1966 | Smilgys | 101/110 |
| 3,338,160 | 8/1967 | Heil | 101/111 X |
| 3,482,512 | 12/1969 | Jung | 101/110 |
| 3,744,411 | 7/1973 | Becker | 101/111 |
| 3,796,152 | 3/1974 | Finke et al. | 101/111 |
| 3,927,613 | 12/1975 | Nantz | 101/110 |
| 3,968,745 | 7/1976 | Hamisch, Jr. | 101/111 |

*Primary Examiner*—Edgar S. Burr
*Assistant Examiner*—Paul J. Hirsch
*Attorney, Agent, or Firm*—Ostrolenk, Faber, Gerb & Soffen

[57] ABSTRACT

A printing head for precisely printing bar code characters, which printing head is mounted on a portable label printing machine or the like and comprises: a pair of frame plates; a plurality of bar code type rings carrying a series of bar code types therein; carriers for indicia to indicate the type face on a type ring then at the print position; a type ring selector shaft movable to each type ring for selecting a particular type on each bar code type ring; the distance between the frame plates is slightly larger than the total thickness of the type rings; a pressing means to press the type rings together in the axial direction is positioned between one frame plate and the type rings; the pressing means releases the type rings when they are to be rotated in a type selection step; in one embodiment, type face arranging bars are passed through the type rings for attaining uniform flatness of type face; in an embodiment there are separate type rings and indicia carrying rings and there is an interlocking mechanism interlocking the type rings and the indicator rings.

22 Claims, 35 Drawing Figures

FIG. 13 (a)
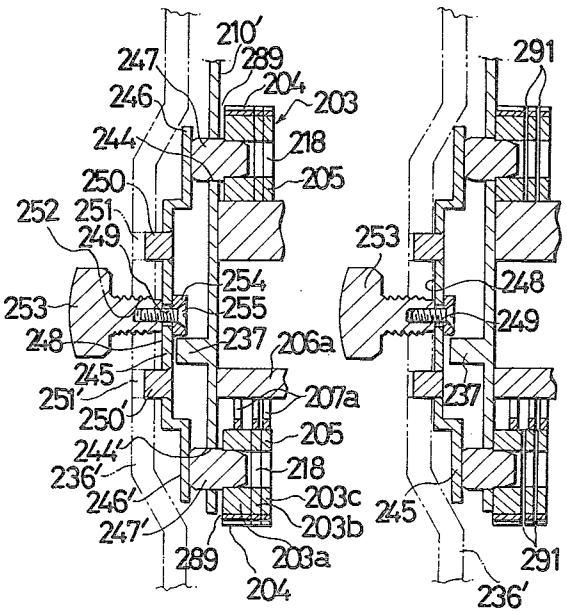
FIG. 13 (b)
FIG. 12
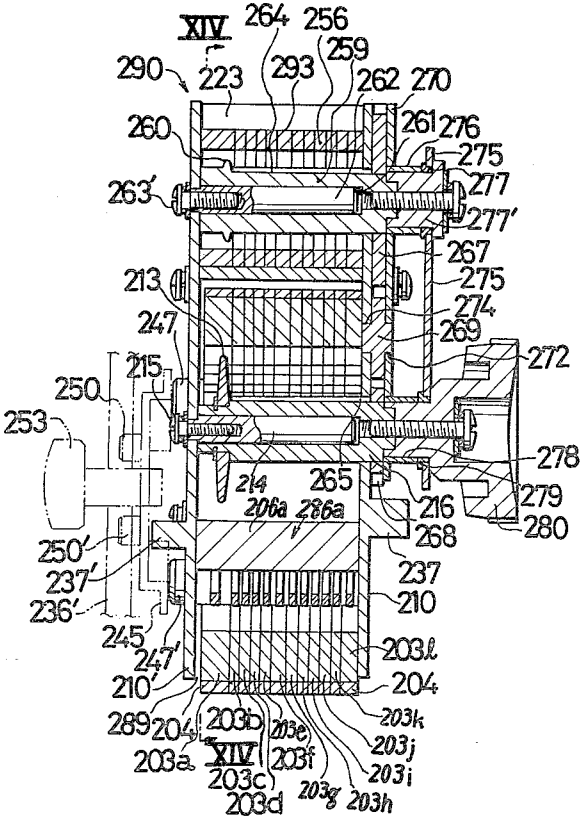

FIG.25
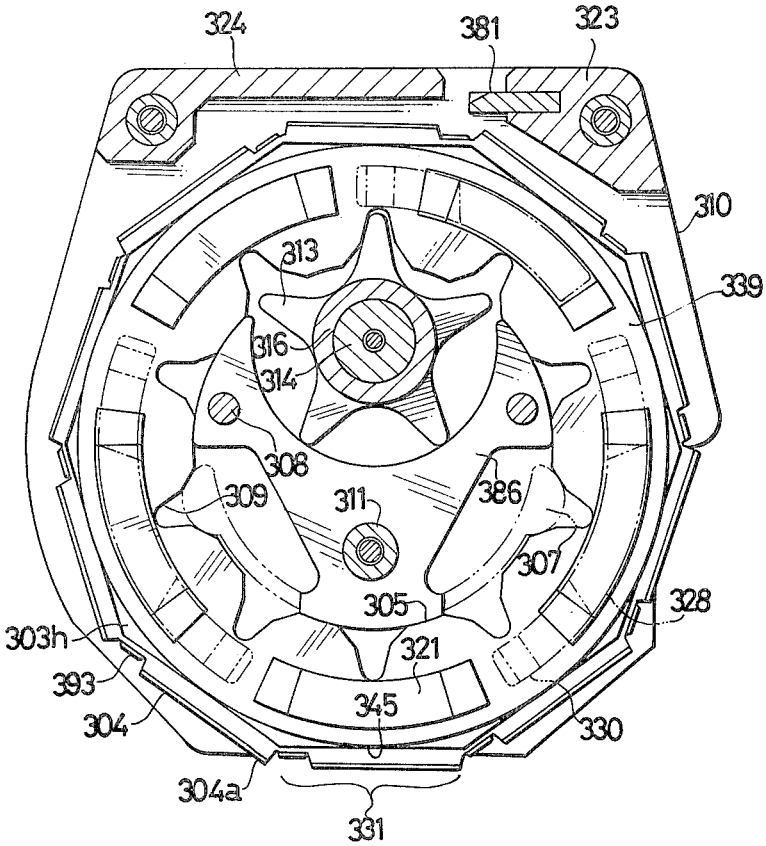
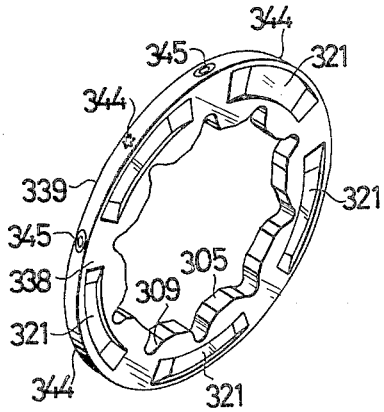
FIG. 26(a)
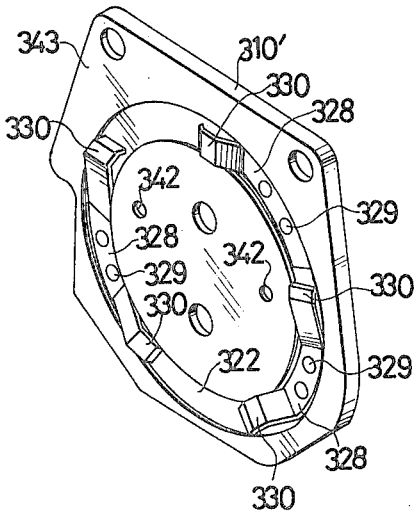
FIG.26(b)

PRINTING HEAD FOR PRINTING BAR CODE CHARACTERS

BACKGROUND OF THE INVENTION

This invention relates to a printing head which is mounted on a portable label printing machine, a desk-type price tag printing machine or the like. More particularly, the invention relates to a printing head which is used for printing bar code characters that are readable from any direction by an optical reading means.

This invention provides a printing head, without an inking device, for printing the bar codes on large-sized labels with required precision. The bar codes are, for example, long and narrow marks arrayed side-by-side and readable from any direction by an optical reading means.

In recent years, computerized POS (point of sales) systems have been adopted in large supermarkets for foods and other household goods. One information indicating means in the POS system is a bar code, the UPC (universal product code) symbol marks which have been developed and established by the American Supermarket Institute. The fundamental consideration in the development of the UPC symbol marks was that the conventional price labels were to be abolished. In this system, the code numbers of markers, kinds of commodities and so forth are represented by the UPC symbol marks. This system was contemplated for source marking, in which the bar codes of UPC symbol marks are applied on the packing boxes and bags when they are produced and thus before they are loaded or filled. Thus, the UPC symbol marks have been printed by large-sized printing machines installed in a packing material factory which make precise and clear prints for optical reading.

Following adoption of the POS system by supermarkets, it has been found that the source marking is insufficient for a complete POS system. Although source marking can be adopted for dry foods, or the like which are produced and/or packaged in food works and certain quantities of which are packed there, the source marking is unsuitable for perishables such as green vegetables and fresh meat. It has thus become necessary to adopt instore marking for commodities to which the bar codes of the UPC symbol marks have not been applied during source marking. For this instore marking, portable label printing machines are used. The UPC symbol marks are printed on labels by the portable printing machines and the printed labels are attached on the surfaces of commodities.

Portable label printing machines are commonly used for printing prices and production dates on labels and for then applying the labels on commodities. The printed information provides purchase information for the customers and information for totalizing the sales by cashiers. When the indicia can be read with the eyes, they are regarded as sufficiently precise.

The UPC symbol marks developed for the purpose of source marking have strict requirements that each character comprise two dark bars and two light spaces, all about 23 mm in length and all arranged in parallel. The breadth of each character is 2.311 mm. with a tolerance of $\pm$ 0.096 mm.

A rotary printing head, in which types are selected by rotating type rings or stamp belts, are used in the portable label printing machines used in store fronts. But, when the bar code characters of UPC symbol marks are printed on labels by using a conventional portable label printing machine, the preciseness of printed bar code characters is insufficient and optical reading is impossible. When a type ring that has bar code types is axially moved, the breadth of the light spaces are varied and optical reading becomes impossible. Furthermore, in the rotary printing head, there is sideways play, as clearances are formed between the adjoining type rings so as to enable the type rings to rotate easily.

Heretofore, the strict requirements for imprinting UPC symbol marks could not be satisfied using rotary printing heads in the portable label printing machine. THe requirement for precise printing of UPC symbol marks was the most significant obstacle against the adoption of the rotary printing heads.

Further, the conventional rotary printing head is disadvantageous in that the indicating indicia are liable to be stained with ink and are hardly visible as they are small, so that the selection of types becomes troublesome.

In summary, the printing of bar codes of UPC symbol marks by using the conventional portable label printing machine has not been accomplished.

BRIEF SUMMARY OF THE INVENTION

In view of the above, the primary object of the present invention is to provide a bar code printing head which is able to be mounted on a portable label printing machine and which prints labels with bar codes that are readable by optical reading means.

Another object of the present invention is to provide a bar code printing head, in which a plurality of type rings thereof can be brought into firm side-by-side contact at the printing step.

A further object of the present invention is to provide a bar code printing head, in which the type rings can be smoothly rotated, particularly through the formation of gaps between the type rings, during the selection of types.

A further object of the present invention is to provide a type ring pressing mechanism, by which slight clearances are formed between arrayed type rings during the type selecting operation so as to enable smooth rotation of each of type rings, while the clearances can be removed after the selection of type rings so as to form a tightly combined type face of bar code types.

According to the present invention, the bar code printing head comprises a plurality of type rings that are supported on a carrier member attached to a pair of opposed frame plates. The distance between the frame plates is made slightly larger than the total thickness of the type rings. A pressing means presses the type rings in the axial direction. Usually the pressing means is located between one frame plate and the type rings. During printing steps, the pressing means presses the type rings together for holding a precise arrangement of bar code types on the type rings. Thus, the precise type spacing is attained which meets the standard requirement of UPC symbol marks. During the type selecting step, the pressing means releases the pressure on the type rings to allow clearances between adjacent type rings to form and enable the type rings to be rotated smoothly. A means for rotating the type rings is disclosed in my co-pending application, Ser. No. 658,491, filed Feb. 17, 1976, entitled "Printing Head for Portable Labeling Machine, or the Like".

In one embodiment, the indicator means for indicating which type ring is then being rotated and the selector shaft for selecting the type ring to be rotated and for then rotating that ring are connected to a common connecting plate. That embodiment may also comprise a type face arranging mechanism, in which type face arranging bars are inserted into alignable arrangement holes formed in every type ring so as to align all type rings and make the type face even. In a preferred arrangement, the type face arranging bars are also integrally attached to the connecting plate so as to be moved therewith.

In some embodiments, desired types can be selected by rotating large indicator wheels with the selector shaft and watching the indicating indicia on the wheels. Also, in this embodiment there are separate indicator wheels, separate from the type rings. The indicator wheels can be made quite large by the provision of an appropriately sized intermediate gear. The indicating indicia on the separated indicator wheels can be made large and easily visible. Also they are not strained with ink. Thus, the selection of desired types can be effectively attained.

BRIEF DESCRIPTION OF THE DRAWINGS

The foregoing and other objects and features of the present invention will become apparent from the following description taken in connection with the accompanying drawings, in which:

FIGS. 6(*a*) and (*b*) are enlarged fragmentary views of a portion of FIG. 6 at two operational positions;

FIG. 9(*a*) is a cross-sectional end view of the main portion of the type ring assembly;

FIG. 12 is a vertical cross-sectional front view of a second embodiment of the printing head;

FIG. 13(*a*) and (*b*) are vertical cross-sectional views of the embodiment of FIG. 12;

FIG. 25 is an enlarged cross-sectional view taken along the line XXV—XXV in FIG. 19;

FIG. 26(*a*) is a perspective view of a non-type ring used in this embodiment of the printing head;

FIG. 26(*b*) is a perspective view of a frame plate used with the ring of FIG. 26(*a*);

DETAILED DESCRIPTION OF A PREFERRED EMBODIMENT

Figure 1:
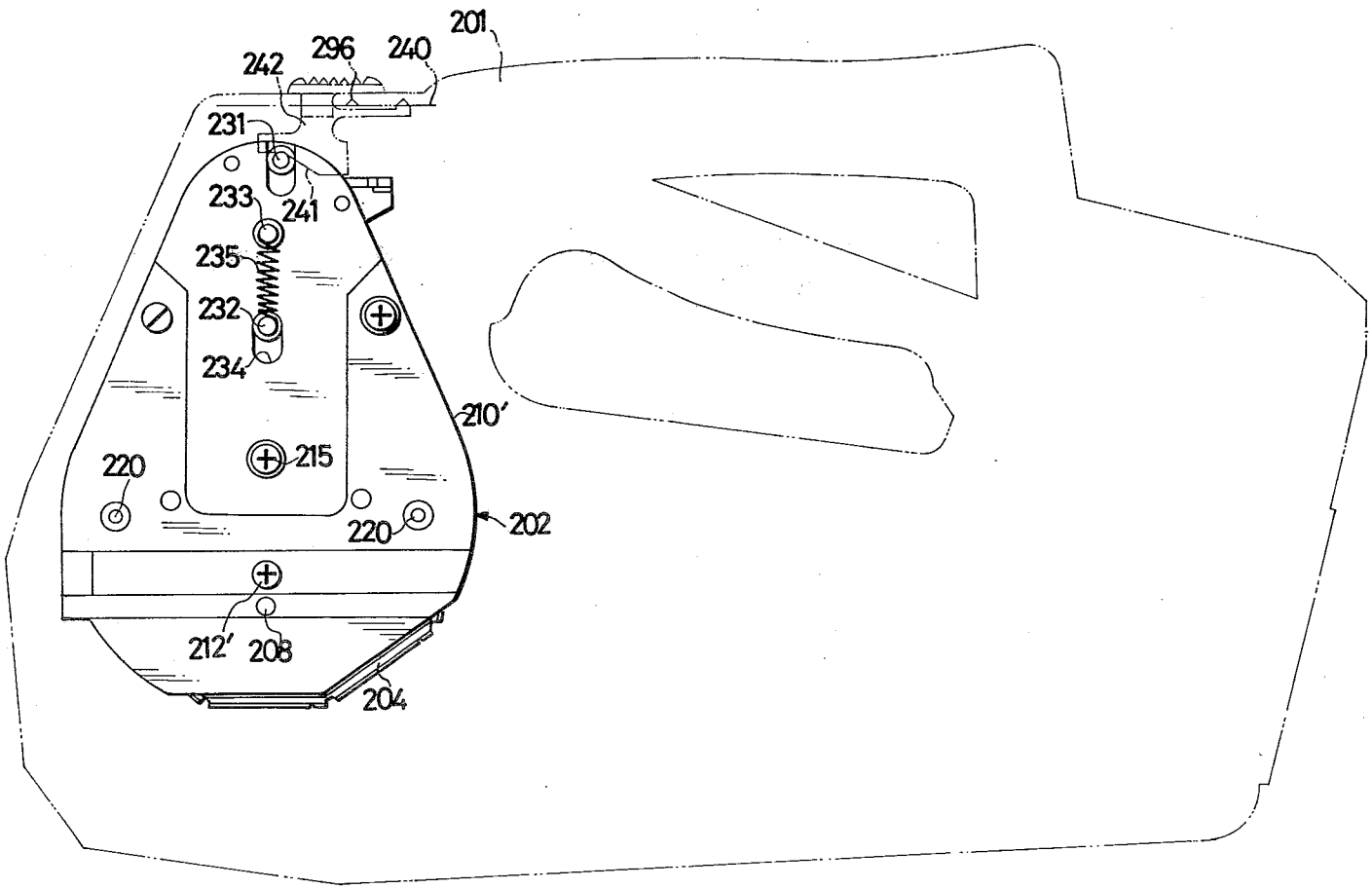
FIG. 1 is a schematic side elevational view of the printing head of a first embodiment of the present invention which is mounted on a portable label printing machine.

In FIG. 1 of the accompanying drawings, the first embodiment of printing head of the present invention is shown mounted on a portable label printing machine. This label printing machine 201 supports and feeds a label strip, prints indicia on each label of the label strip, peels each printed label from a backing strip, and is used for applying the printed label on a desired article. Such mechanism, although not shown, is well known. See, for example, U.S. Pat. No. Re. 27,889. The printing head 202 of the present invention is mounted on the label printing machine 201.

As shown in FIGS. 4, 8, 9, 11 and 14, each type ring 203 is of regular decagonal shape and has an open center. Each peripheral side of each decagonal type ring 203 carries a single encoded bar code type or character 204 which corresponds to one of 10 numerals from 0 to 9. Inner female gears 205 are formed on the inside of the type ring 203. There is a generally circularly curved supporting plate 206 inside each gear 205. Each plate 206 is integrally provided with a pair of elastic pieces 207 on its periphery. The elastic pieces 207 are resiliently urged radially outwardly. Thus, the outer faces of the eleastic pieces 207 contact the tooth crests of the inner gears 205 of the type ring 203.

A block like axially extending supporting member 286 is formed by a plurality of supporting plate 206 which are integrally joined by a common supporting shaft 208 on which all plates 206 are supported. There are the same number of supporting plates 206 as there are type rings 203 arranged together in side-by-side relationship. In the illustrated example, a group of type rings 203*a*, 203*b*, *203c*, 203*d*, 203*e*, 203*f* and 203*g* seats side by side on this axial supporting member 286.

The elastic pieces 207 of each supporting plate 206 are caused to engage with the recesses 209 of inner gears 205.

Both ends of the supporting shafts 208 are attached to a pair of frame plates 210 and 210′ which form the frame body 290 of the printing head of this embodiment. Within the frame body 290, the type rings 203 are rotatably supported together with the supporting member 286. The frame body 290 supports the group of type rings 203 from both sides. A tubular shaft 211*a*, which is screw threaded on its interior, is inserted into a through hole formed in and extending through the member 286. Set screws 212 and 212′ are screwed into the threaded openings in the tubular shaft 211*a* from the outsides of the frame plates 210 and 210′, respectively. This determines the inside measurement of the frame body 290.

Figure 6:
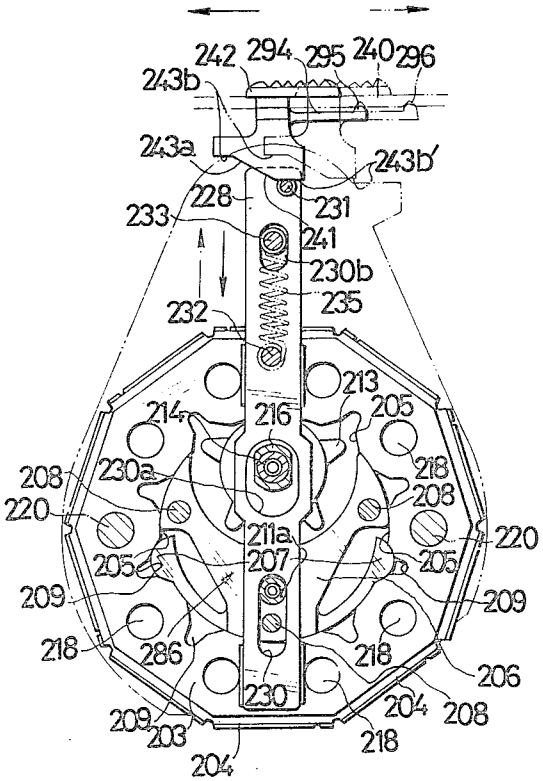
FIG. 6 is a side view showing the relationship among type rings, a type ring push plate and a slide piece.
Figure 7:
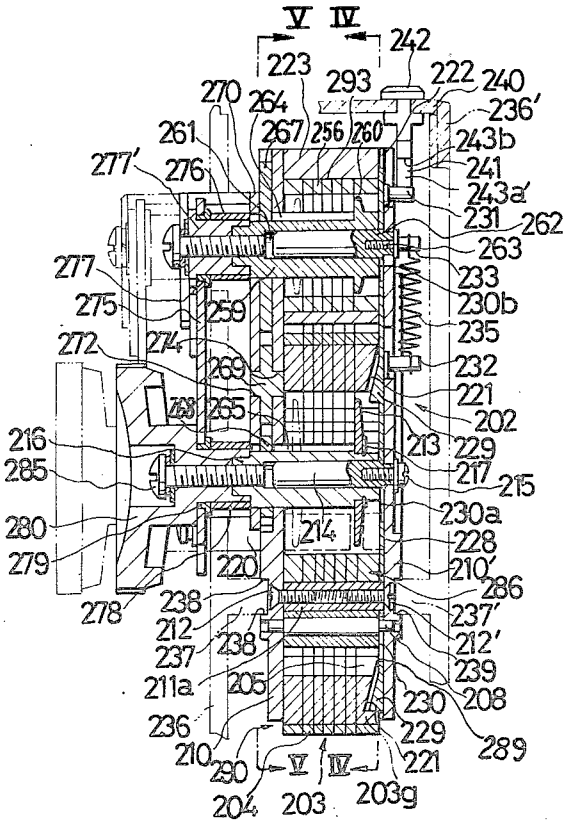
FIG. 7 is a vertical cross-sectional front view of the printing head.
Figure 6A:
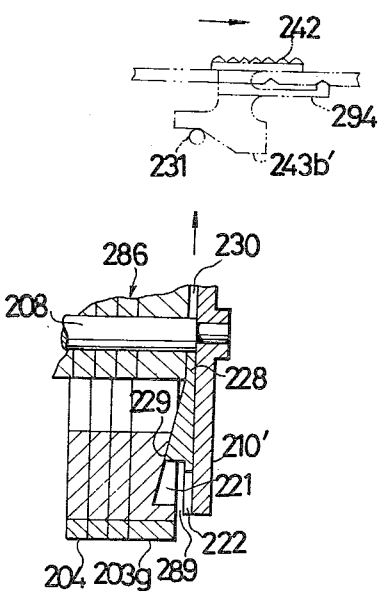
Figure 6B:
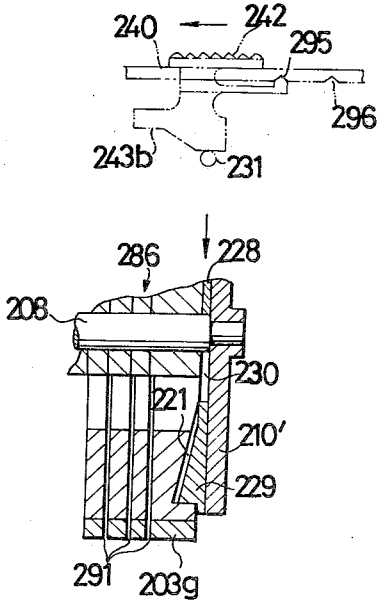
Figure 9A:
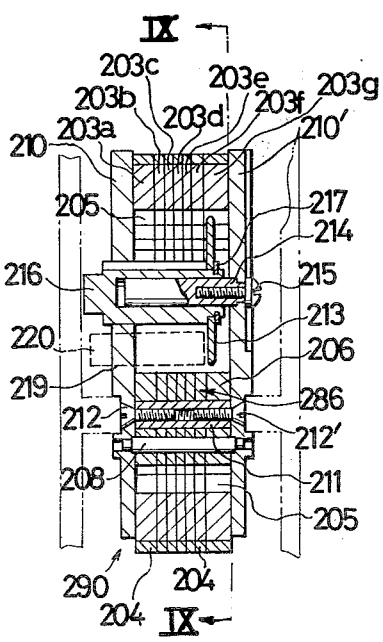
FIG. 9 is cross-sectional side view of the main portion of the type ring assembly along the line IX—IX in FIG. 9(*a*)

As shown in FIGS. 6 and 7, there is a single type ring pinion 213 that is held in the space between the arc formed by the tooth crests of the inner gear of any one type ring 203 and the upper arcuately curved surface of the axial supporting member 286. The type ring pinion 213 has teeth that are shaped, spaced and sized and are of a thickness or width to engage with the recesses of one of the inner gears 205 of type ring 203 at a time. Rotation of pinion 213 rotates the type ring 203. One end of a hollow selector shaft 216 is attached to the frame plate 210 and extends outside it. The other end of the selector shaft 216 has an axial hole formed in it through which a pivotal shaft 214 is inserted. The other or right side end (in FIG. 7) of the pivotal shaft 214 is attached to the frame plate 210′ by a screw 215. Accordingly, the selector shaft 216 can be slid along the axis of the pivotal shaft 214 within the frame body 290. The type ring pinion 213 is fixed on the selector shaft 216 by means of a snap ring 217.

Type Face Arranging Mechanism

The type rings 203 are held on the outer surface of the axial supporting member 286. However, with such a supporting mechanism, the flatness or alignment of the type faces of all of the bar code types 204, which are arranged in side by side relationship, is not satisfactory. To provide for proper alignment, each of the type rings 203*a*, 203*b*, 203*c*, 203*d*, 203*e*, 203*f* and 203*g* is provided with a plurality of arrangement holes 218 at suitable radial and arcuately spaced positions. The holes 218 formed in all of the type rings 203 are aligned on the same axes, and particularly are located along the radii of the meeting places of adjacent type faces 204.

The frame plate 210 has a pair of type ring arrangement holes 219 located at diametrically opposed symmetrical positions. By inserting type face arranging bars 220 into the arrangement holes 218 and 219, the flatness and alignment of type faces formed by the types 204 of type rings 203 can be improved.

To set a particular type bar code, the screws 212 and 212′ are loosened and the arranging bars 220 are pulled out. The type rings 203 are then rotated, as described below, to form a desired type face. Then, the arranging bars 220 are reinserted into the arrangement holes 218 and 219 and the screws 212 and 212′ are tightened. Because the stop positions of the type rings can be precisely set, the total flatness of the selected types 204 of the bar code type faces is well maintained and there can be high precision printing.

To perform a type ring rotation, when the face of a desired type 204 is to be set by rotating the type ring 203*d*, for instance, and if the type ring pinion 213 is in engagement with the type ring 203*g*, the knob of the selector shaft 216 outside the frame plate 210 is pulled so as to move the type ring pinion 213 toward the type ring 203*d*, eventually to engage the pinion 213 with the inner gear 205 of the type ring 203*d*. Then the selector shaft 216 is rotated. The elastic pieces 207 of the supporting plate 206 of the type ring 203*d* are caused to resiliently engage the recesses 209 of the respective inner gear 205. The positioning of a desired type 204 of the type ring 203*d* can be easily performed. By subsequent tightening of the screws 212 and 212°, the type rings 203 are pressed together without leaving clearances between adjacent type rings 203.

Type Ring Pressing Mechanism

As a practical matter, it is bothersome to loosen the screw 212 and 212′, and to operate the type face arranging bars 220 at every selection of particular types 204. The type ring pressing mechanism shown in FIG. 7 eases this operation. This mechanism is provided with a cylindrical shaft 211*a* which is slightly longer than the total thickness of the arrayed type rings 203*a*–203*g*. To accommodate this, the inside width of the frame body 290 is larger than the total thickness of the type rings 203*a*–203*g*. Thereby, a space 289 is formed between the inside wall of the frame plate 210′.

Figure 2:
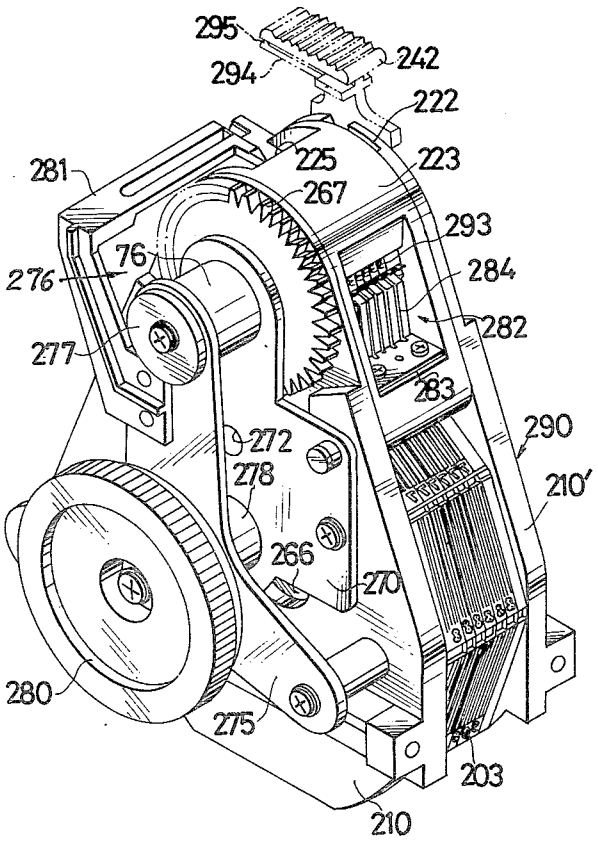
FIG. 2 is a perspective view of the first embodiment of the printing head shown in FIGS. 1 to 10, inclusive.
Figure 4:
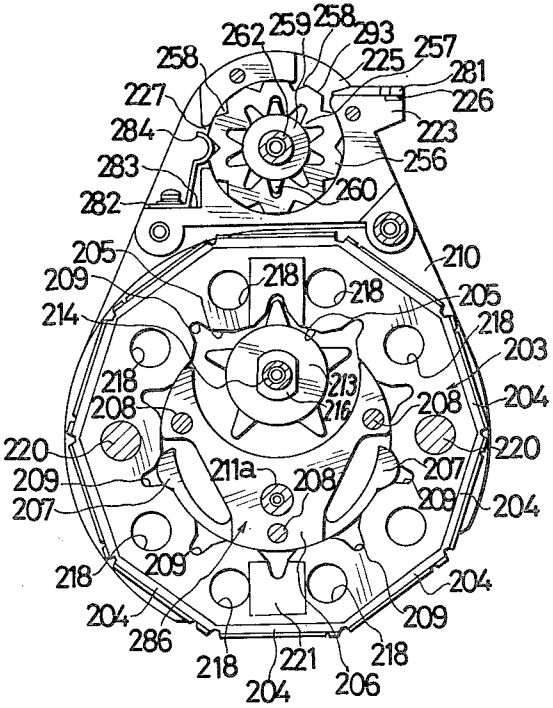
FIG. 4 is a cross-sectional view taken along the line IV—IV in FIG. 7.
Figure 8:
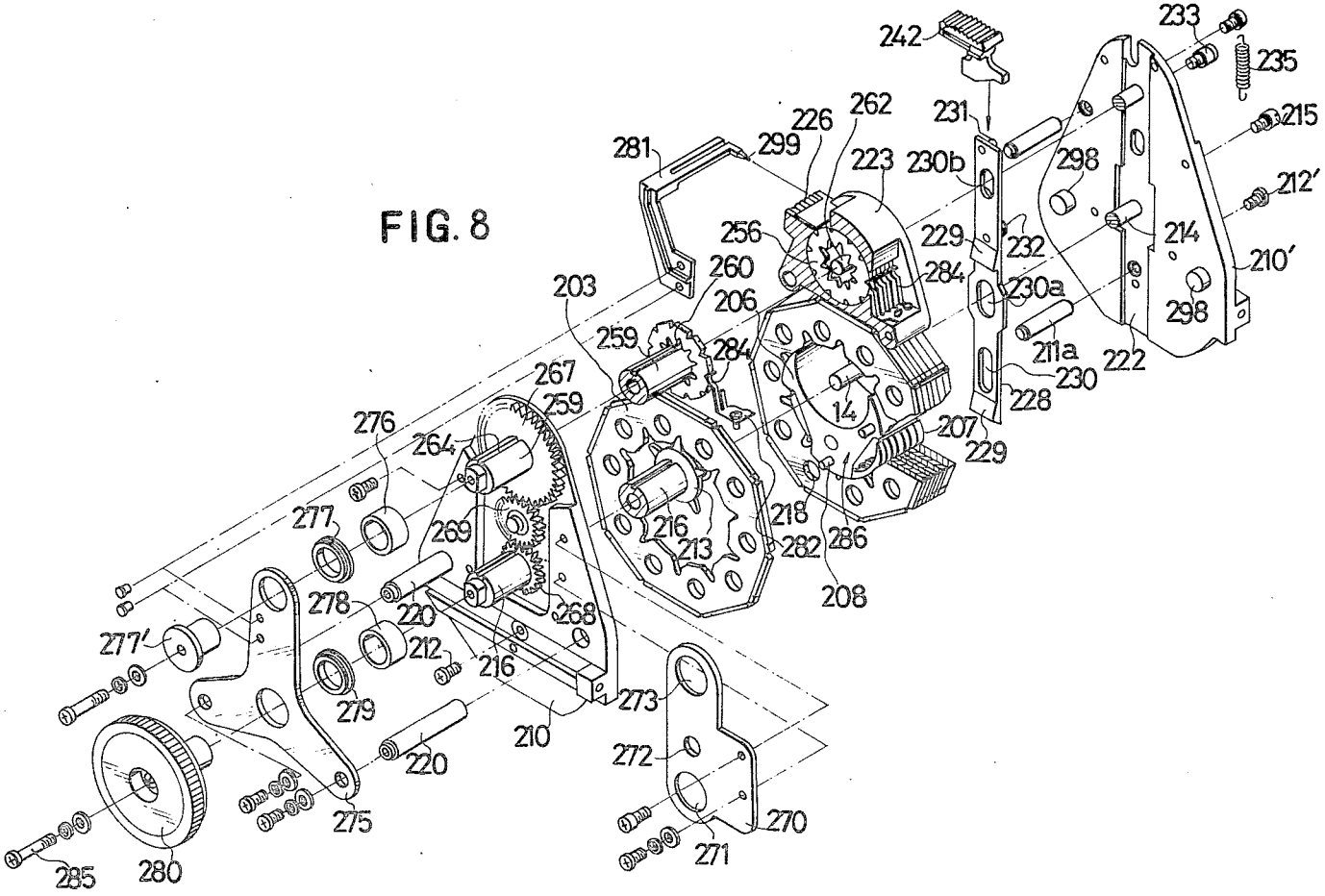
FIG. 8 is a perspective assembly drawing of the printing head of the present invention.
Figure 9:
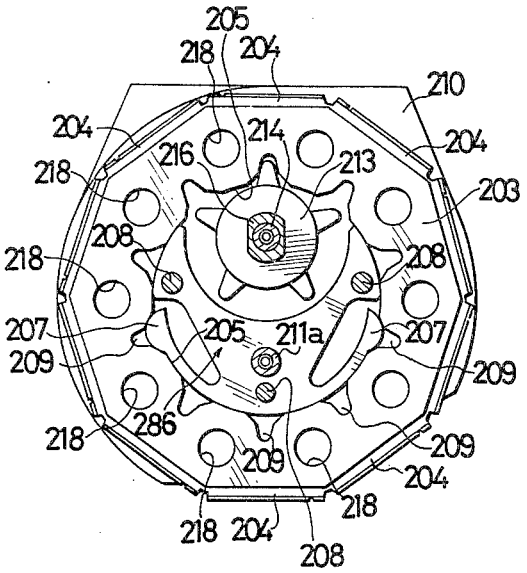

As shown in FIG. 8, however, the cylindrical shaft 211*a* is positioned at the lower part of frame body 290 that is comprised of the frame plates 210 and 210′. Thus, in order to leave the same space also in the upper part of frame body 290 between the frame plates 210 and 210′, the below described indicator frame 223 is firmly attached to the upper part of the frame body 290 as shown in FIG. 2. On the outside of the type ring 203*g*, inclined depressions 221 are formed as shown in FIGS. 7 and 11(*c*) to define inclined faces near the frame plate 210′.

Figure 11A:
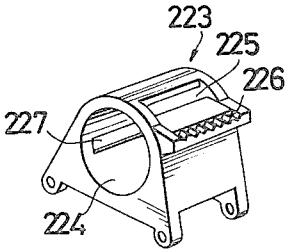
FIGS. 11(*a*), (*b*) and (*c*) are perspective views of an indicator frame, a type ring push plate and a type ring.
Figure 11B:
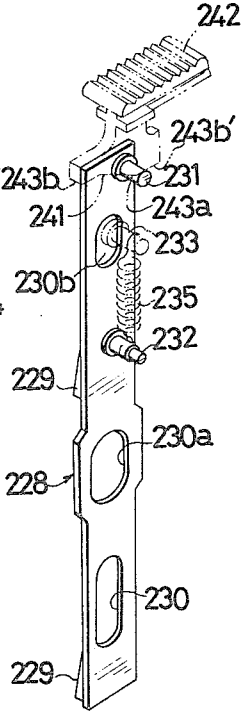
Figure 11C:
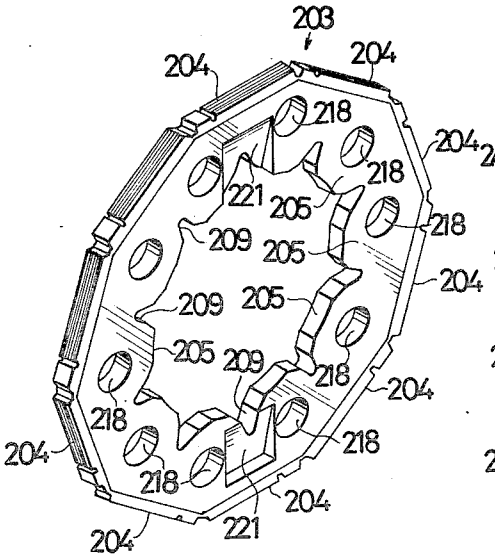
Figure 15:
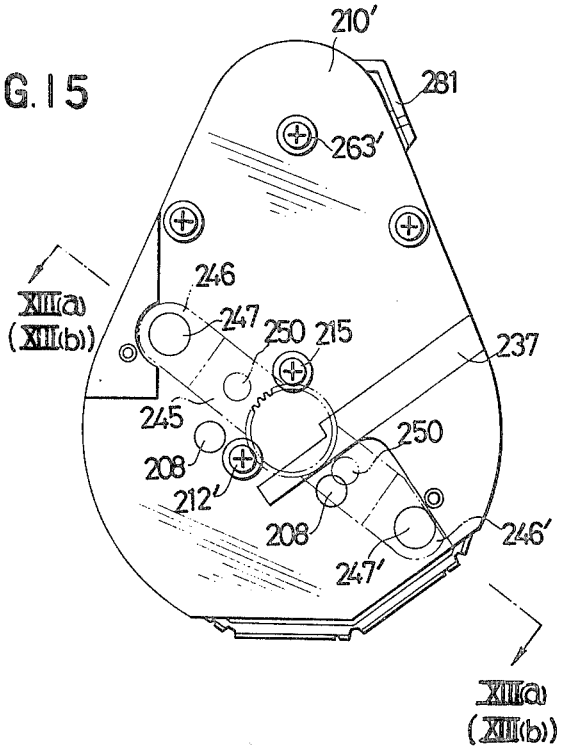
FIG. 15 is a side elevational view of the second embodiment of printing head.

The inside wall of the frame plate 210′ has a vertical guide channel 222, in which a type ring push plate 228 is emplaced, as shown in FIGS. 8 and 11(*b*). When the type ring push plate 228 is inserted into the guide channel 222, the outer surface of the push plate 228 and the inside wall of the frame plate 210′ are in the same plane. Thus, when the indicator wheel frame 223 is fitted to the frame plate 210′, as shown in FIG. 2, the push plate 228 is still movable vertically.

The space 289 between the type ring 203*g* and the inside wall of the frame body 290 also provides space for the type ring push plate 228 to be fitted into the guide channel 222.

Centrally along its length and at the lower end of the inwardly facing side of the type ring push plate 228, push lugs 229 are formed. The lugs 229 have inclined surfaces which incline downwardly and outwardly from the vertical side wall in the lower, diagonal direction. Further, oval shaped, vertically elongated relief holes 230, 230*a* and 230*b* are formed in the push plate 228. On the side of the push plate 228 near the frame plate 210′, there is a drive pin 231 at the upper end of plate 228 and a support pin 232 in the middle portion beneath the central relief hole 230*b*.

The attachment of the type ring push plate 228 is described with reference to FIGS. 6, 7, 8 and 11(*b*). The cylindrical shaft 211*a* is inserted into lower, elongated relief hole 230. The pivot shaft 214 of the selector shaft 216 is inserted into central elongated relief hole 230*a*. The spring pin 233 which is affixed to the frame plate 210' is inserted into the upper relief hole 230*b*. The type ring push plate 228 is fitted into the guide channel 222. As shown in FIG. 1, the support pin 232 projects outside the frame plate 210' through the slot 234. A tensioned raising spring 235 is stretched between the support pin 232 and the spring pin 233 and this normally biases the type ring push plate 228 upwardly. Thus, the inclined surfaces of push lugs 229 are spring biased to slide up the inclined surfaces of depressions 221, thereby pressing the ring 203*g* in the axial direction of support 286, sideways, to the left in FIG. 8.

As the arrayed type rings 203 are pushed toward the frame plate 210, the clearances 291 between adjacent type rings 203 are closed and the type rings 203 are tightly pressed together to form one body. In this state, the space 289 is formed between the inside wall of the frame plate 210' and the surface of type ring 203*g*.

As shown in FIG. 8, the inside wall of the frame plate 210' is provided with rotation stopping bosses 298 at the same positions as the arranging bars 220. Each boss 298 is a little shorter than the thickness of the type ring 203*g* and the diameter of the boss 298 is somewhat smaller than the inner diameter of type ring arrangement hole 218. The bosses 298 are fitted into the arrangement holes 218 of the type ring 203*g*. Thus, the bosses stop rotation of only the type ring 203*g*. However, this ring can be freely moved in the axial direction of support 286.

As shown in FIG. 7, the inside walls of the machine frames 236 and 236' of the label printing machine 201 carry support posts 237 and 237' which are received in the supporting grooves 238 and 239 formed on the outsides of the frame plates 210 and 210'. The printing head 202 is thus mounted on the label printing machine 201.

On the upper edge of the machine frame 236' on the side near the type ring push plate 228, a cover rim 240 is integrally formed. A slide piece 242 that is slidable longitudinally sideways, as shown in FIG. 6, is fitted to the cover rim 240. A vertically depending wall of the slide piece 242 has a bottom surface 241 which is comprised of an inclined surface 243*a* which is lower at the right side in FIG. 6, an upper horizontal surface 243*b* at the upper end of inclined surface 243*a* and a lower horizontal surface 243*b'* at the lower end of surface 243*a*. The slide piece 242 has projecting from its right side in FIG. 6 a resilient engaging piece 294 which has an upwardly extending engagement projection 295 at its tip, which projection is adapted to be received in the correspondingly shaped recesses 296 formed on the undersurface of the cover rim 240.

The bottom surface 241 of the slide piece 242 is always held in contact with the drive pin 231 by the force of the tensioned slide piece raising spring 235. When the slide piece 242 is in the front or solid line, left hand position in FIG. 6, i.e. the position of FIG. 6(*b*), this is when the types 204 may be selected by rotation of rings 203 because of the existence of clearances 291. Also, the drive pin 231 engages the lower horizontal surface 243*b'*.

On the other hand, when the slide piece 242 is in the rear or broken line, right-hand position in FIG. 6, i.e. the position of FIG. 6(*a*), which occurs during the printing state, clearances 291 are gone and the space 289 exists, then the drive pin 231 engages the upper horizontal surface 243*b* due to the bias of raising spring 235.

In this embodiment, when desired types 204 on all of the type rings 203 are selected, the arranging bars 220 are first pulled out in the axial direction, then the slide piece 242 is moved forward or to the left, as shown in FIG. 6, and this causes the engagement projection 295 to engage with a recess 296. The drive pin 231 is lowered together with the attached type ring push plate 228, and the inclined push lugs 229 are received in the correspondingly inclined depressions 221. This releases the secure contact of the type rings 203 and forms clearances 291 between the adjoining type rings 203. Accordingly, any type ring 203 of the arrayed type rings 203*a–g* can be selected with pinion 213 and rotated. Reinsertion of bars 220 at this point is recommended.

When selection of the types to be printed is made, the slide piece 242 is moved rearward or to the right, as shown in FIG. 6, until the engagement projection 295 is received in another recess 296 (not shown) and until pin 231 is at surface 243*b*. The type ring push plate 228 is raised by the force of the raising spring 235, and the drive pin 231 is raised along the inclined surface 243*a* of the bottom face 241 of slide piece 242 and the type ring push plate 228, the push lugs 229 press the side surface of the type ring 203*g* toward the frame plate 10. The clearances 291 formed between type rings 203 close and the type rings 203 are pressed together. Therefore, the bar code types 204 of all the type rings 203 are arrayed at desired regular intervals forming a type face with required spacing between types. In this state, the space 289 develops between the inside wall of the frame plate 210' and the side surface of the type ring 203*g*.

Another Embodiment of the Type Ring Pressing Mechanism

The pressing mechanism for type rings 203 in another embodiment of the present invention is now described with reference to FIGS. 12 and 13.

A pair of pressing holes 244 and 244' are formed in the frame plate 210' at positions corresponding to the type ring arrangement holes 218 of type ring 203*a*. A rectangularly shaped type ring push plate 245 provides for the clearances 291 between adjoining type rings 203*a*–203*l*. The rear or right hand sides of wing portions 246 and 246' of plate 245 press columnar push heads 247 and 247'. An opening 249 is formed at the center of the top surface 248 of the type ring push plate 245. At counter positions on both sides of this opening 249, guiding projections 250 and 250' are formed.

The push heads 247 and 247' are inserted into the pressing holes 244 and 244'. The tip ends of the push heads 247 and 247' on the side near the frame plate 210 are fitted into the arrangement holes 218 of the type ring 203*a* and they are tightly fixed. Accordingly, with the push heads 247 and 247' in place, the type ring 203*a* is not rotatable but is only movable in the axial direction.

The guiding projections 250 and 250' on plate 245 are fitted into the guide holes 251 and 251' formed in the machine frame 236'. The type ring push plate 245 is fitted between and is slidable between the frame plate 210' and the machine frame 236'. The type ring push plate 245 has a central hole 249 therethrough. At the same position as the hole 249 in the plate 245, the machine frame 236' is provided with a screw hole 252, through which a pushing screw 253 is inserted. The tip end of the screw 253 is positioned at the hole 249 of the type ring push plate 245. From the other or right side of the type ring push plate 245, a screw 255 is tightened into a threaded hole in screw 253 and there is an interposed fitting plate 254, thereby attaching the tip end of the pushing screw 253 to the type ring push plate 245.

Figure 14:
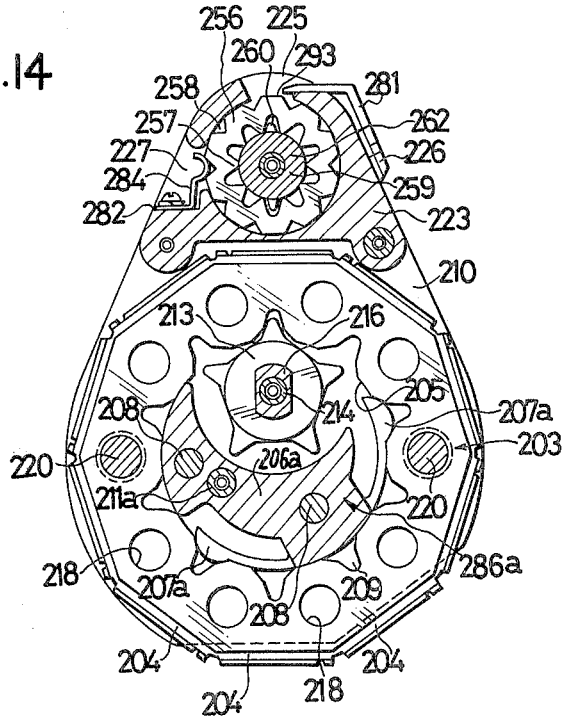
FIG. 14 is a vertical cross-sectional view taken along the line XIV—XIV in FIG. 12.

As shown in FIGS. 12, 13 and 14, the blocklike axially extending supporting member 286*a* of this embodiment is different from the supporting plates 206 of the previous embodiment. There are the same number of plate members 206*a* as there are type rings 203 fitted together. The supporting member 286*a* is integrally formed together with a pair of elastic engaging pieces 207*a* for each type ring 203 and these facilitate assembling work.

With the above-disclosed structure, when any one of type rings 203*a*–203*l* is to be rotated, the pressed together state of rings 203 is released, as shown in FIG. 13(*b* ). As before, the arranging bars 220 are disengaged. The type ring push plate 245 is slid toward the machine frame 236' by rotating the pushing screw 253 to move to the left. This releases the close contact of the type rings 203*a*–203*l*. Thus, clearances 291 are formed between the adjacent type rings 203 and any of the type rings can be freely rotated.

To remove the clearances 291 as shown in FIG. 13(*a*), the type ring push plate 245 is pressed toward the frame plate 210 by rotating the pushing screw 253 to move right. Thus, the push heads 247 and 247' are pushed toward the frame plate 210. This pushes the type ring 203*a* in the same direction forming the space 289. With the formation of the space 289, the clearances 291 between type rings 203*a*–203*l* are removed and the type rings 203 are brought into close contact.

Type Selecting Mechanism

In order to select the desired types 204, it is necessary to disengage the arranging bars 220 and to rotate the type rings 203 while watching the types 204. With reference to FIGS. 2, 3, 5, 7, 11 and 12, an embodiment of the present invention for the type selecting operation is now described.

A hollow indicator wheel 256 for each type ring 203 carries indicia on its periphery that indicate the symbols or letters that correspond to the types 204 on its respective type ring 203. Each indicator wheel 256 is aligned with its type ring 203. On the inside wall of the indicator wheel 256, inner recess gear 257 is formed. In the outer surface, engaging grooves 258 are formed. As shown in FIG. 11(*a*), the indicator frame 223 is shaped like a stool. A bore 224 passes from one side wall to the other side wall of the indicator frame 223. A sight window 225 is formed in the upper part of the indicator frame 223. Window 225 communicates with the bore 224. A wavy surface 226 extends out from the inclined surface on one side of the frame 223. A slot 227 is formed in the inclined surface on the other side of the frame 223 and extends through that surface of frame 223 into the bore 224. The arrayed indicator wheels 256 are held within the bore 224, and the peripheral surfaces of the indicator wheels 256 contact the inside wall of the bore 224.

An indicator shaft 259 has integrally formed projections 260 on its end portion. As shown in FIGS. 7 and 12, an axial bore 261 is formed in the indicator shaft 259 starting at the side of the shaft with the projections 260. The indicator shaft 259 is inserted through the inner gears 257 of the arrayed indicator wheels 256. The projections 260 on the shaft 259 are brought into engagement with the inner gears 257 of each indicator wheel 256.

As shown in FIG. 7, the pivot shaft 262 for the indicator shaft 259 is horizontally secured to the frame plate 210' by a screw 263 that is integrally formed with the spring supporting pin 233. In the type as shown in FIG. 12, the pivot shaft 262 is attached to the frame plate 210' by a screw 263' in like maner as the above.

Accordingly, the arrayed indicator wheels 256 are supported by the inside wall of the bore 224 of the indicator frame 223 which surrounds the indicator wheels 256. At the same time, the insides of the indicator wheels 256 are supported by the indicator shaft 259, the axial bore 261 of which shaft 259 is supported by the pivot shaft 262 attached to the frame plate 210' with the screw 263 or 263'. The end portion of the indicator shaft 259, at its side opposite to the projections 260, projects from the frame plate 210.

Because the indicator shaft 259 is supported by the frame plates 210 and 210', the indicator wheels 256 arrayed in the indicator frame 223 are also supported by the frame plates 210 and 210'. As shown in FIGS. 7 and 12, a key way 264 is formed on the indicator shaft 259 from a projection 260 to the end of the shaft 259 at the side opposite to the projection 260.

Figure 5:
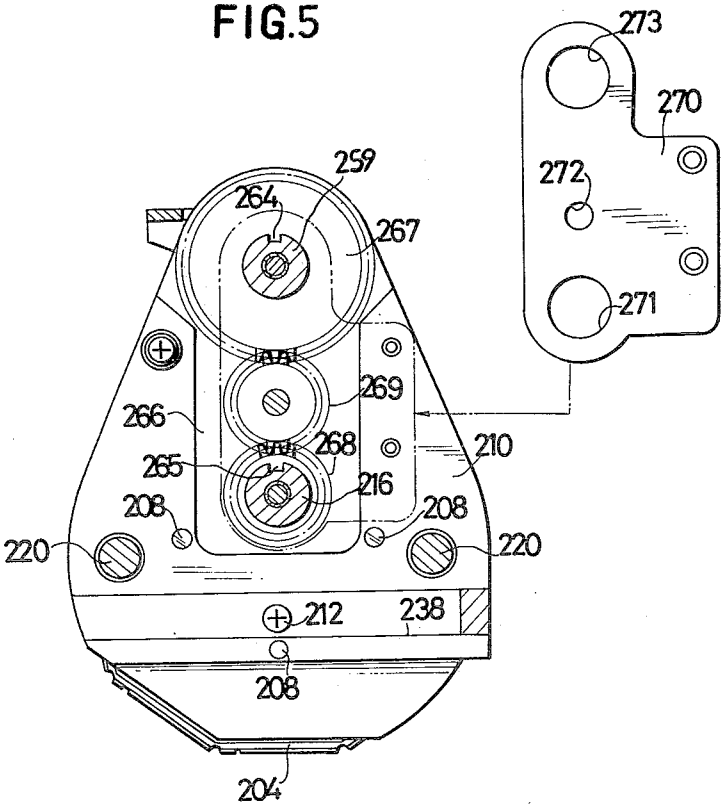
FIG. 5 is a cross-sectional view taken along the line V—V in FIG. 7.

The type selector shaft 216 has also a key way 265, which extends to the end of the shaft 216 on the side opposite to the type ring rotation pinion 213. As shown in FIG. 5, a depression 266 is formed on the outside of the frame plate 210. Further, as shown in FIGS. 5 and 7, an interlocking gear 267 is attached to the key way 264 on the extended end of the selector shaft 216. An intermediate gear 269 is interposed between the drive gear 268 and the interlocking gear 267. Thus, the gears 267 and 268 are interlocked. All of the gears 267, 168 and 269 are held within the depression 266 of the frame plate 210, on which a cover plate 270 is fixed, as shown in FIGS. 5 and 8.

In the cover plate 270, a bearing hole 271 for the selector shaft 216, another bearing hole 272 for the intermediate gear 269 and another bearing hole 273 for the indicator shaft 259 are formed. The intermediate gear 269 is held by the bearing hole 272 and another bearing hole 274 formed in the frame plate 210.

Figure 3:
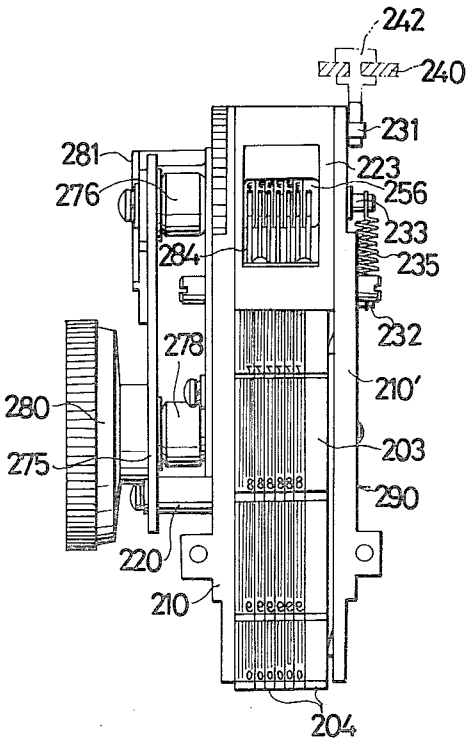
FIG. 3 is a front elevational view of the first embodiment of the printing head.

As shown in FIGS. 2, 3 and 8, the connecting plate 275 is shaped like a star that has three wings spaced 120° apart. The connecting plate 275 is used for simultaneously moving the indicator shaft 259 and the arranging bars 220 by operating the selector shaft 216 when the types 204 are selected. The upper end of the connecting plate 275 is attached to the indicator shaft 259 by a collar member 276 and flange members 277 and 277'. The arranging bars 220 are attached to both side wings of the connecting plate 275 with screws. A selector knob 280 is inserted through the center hole of the connecting plate 275. The selector knob 280 is attached to the selector shaft 216 by a screw 285. A collar member 278 and a ring 279 are interposed between the shaft 216 and the screw 285.

As shown in FIGS. 2, 4, 8 and 14, an indicating member 281 is used for indicating which indicia 293 that are formed on the indicator wheels 256 are the ones corresponding to the types on the type face. Member 281 is attached to the connecting plate 275. The indicating member 281 extends from the connecting plate 275 to the sight window 225 of the indicator frame 223. The tip end of the member 281 is provided with a point 229 which engages with the foregoing wavy face 226 shown in FIG. 11(*a*). Below the slot of the indicator frame 223, a horizontal shelf 283 is formed, on which a positioning member 282 is fixed. The positioning member 282 comprises a base plate and a plurality of elastic pieces 284 attached to the base plate and arranged in a comblike manner. Each elastic piece 284 engages an engaging groove 258 of a respective indicator wheel 256.

When types 204 are selected, the connecting plate 275, selector shaft 216, arranging bars 220 and indicator shaft 259 are all moved horizontally together by pulling out the selector known 280 until the projections 260 engage the indicator wheel 256 which corresponds to the type ring 203 them in engagement with the type pinion 213. When the selector knob 280 is then rotated, the interlocking gear 267 is rotated through the drive gear 268 and the intermediate gear 269, and the indicator shaft 259 is rotated. The indicator wheel 256, which corresponds to the type ring 203 then in engagement with the type pinion 213, is also rotated.

After all of the desired types 204 on all the type rings 203 have been selected, the selector knob 280 is pushed back toward the frame plate 210'. This inserts the arranging bars 220 through the arrangement holes 218 of all type rings 203.

The type pinion 213, projections 260 and arranging bars 220 can be moved simultaneously in the horizontal direction, and the type rings 203 and the indicator wheels 256 can be indirectly moved through the engagement of gears 267, 268 and 269, which are separated from the type rings 203 and the indicator wheels 256 by means of the frame plate 210 and the cover plate 270.

The above disclosed type selection mechanism has the following advantages:

1. In the selection of bar code types 204, both the selection of a particular type ring and then the selection of the rotational position of the particular type ring can be easily performed.
2. With the combination of the gears 205, 257, 267, 268 and 269, the diameter of the indicator wheels 256 can be freely selected without respect to the size of type rings 203. Large indicator wheels 256 can be used, which can carry larger indicating indicia 293. Accordingly, the indicating indicia 293 can be made easily visible and type selection can be performed quickly.
3. The outer surfaces of the indicator wheels 256 are almost covered by the indicator frame 223, except for the portions under the slight window 225. The indicator wheels 256 are operated from outside of the frame plate 210. Therefore, the indicator wheels 256 are kept clear of ink. This enables the desired types 204 to be selected easily and quickly.
4. Since the intermediate gearing mechanism is employed for the interlocking gears 267 of the indicator wheels 256, the pitch diameters of inner gears 257 and 205 of the indicator wheels 256 and type rings 203, and the diameters of the interlocking gear 267 and the drive gear 268 can be relatively freely selected irrespective of the positions of the indicator wheels 256 and the type rings 203. Therefore, the interlocking gear mechanism for the indictor wheels can be made relatively small.

With the foregoing embodiments of printing heads, a number of advantages are realized. With the provision of the type ring pressing mechanism and the type face arranging mechanism, clearance spaces between adjacent type rings can be removed during the printing operation. As a result, precise spacing between adjacent type rings can be obtained. In addition, type faces formed from a plurality of types can be made with all types aligned and exactly flat. With the provision of the type selecting mechanism having enlarged indicating indicia that are not strained with ink, the selection of bar code types can be easily performed.

Another Embodiment of Printing Head

Figure 16:
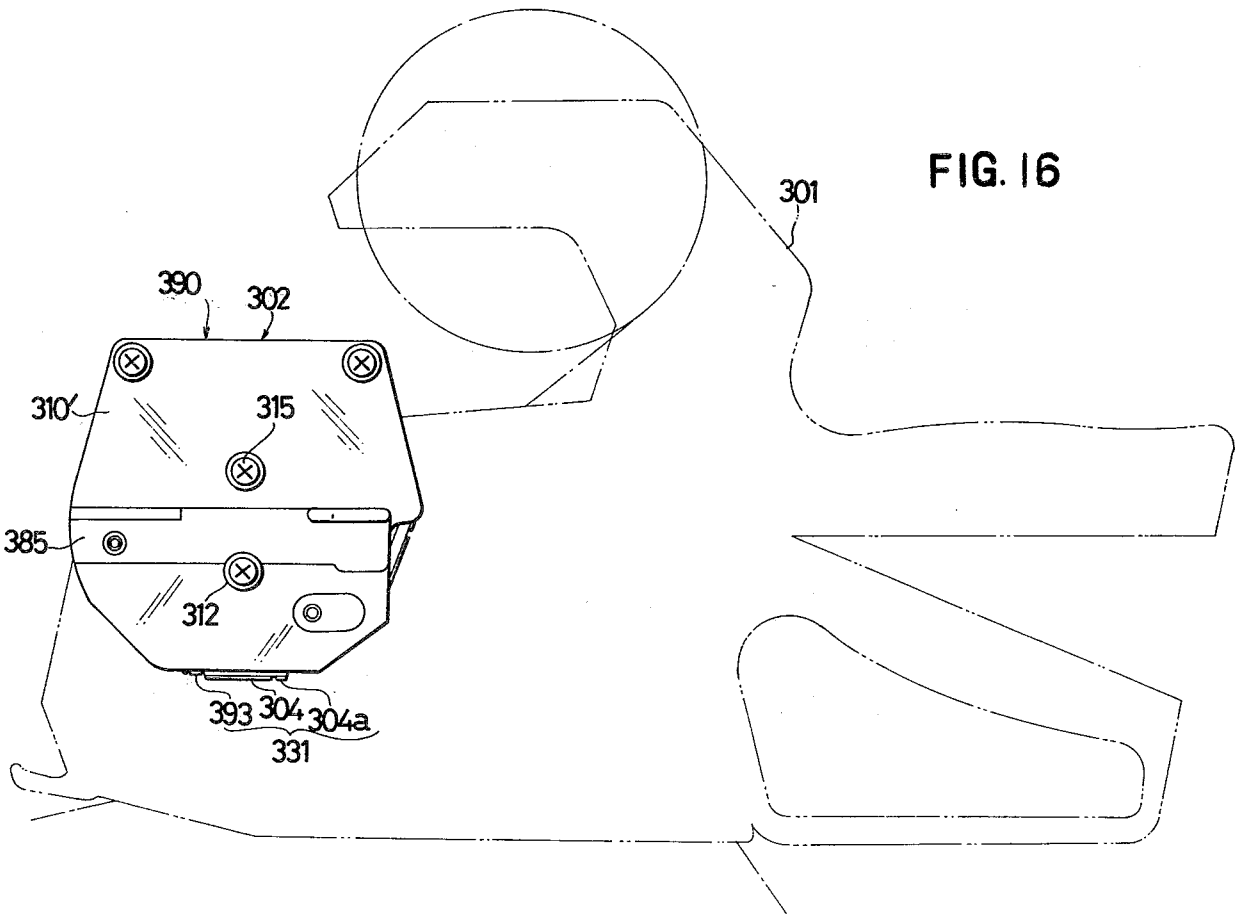
FIG. 16 is a side elevation view of the printing head of a third embodiment of the present invention which is mounted on a portable label printing machine.

A third embodiment of the printing head of the present invention is now described. FIG. 16 shows this printing head mounted on a portable label printing machine. The printing head 302 is mounted in the upper front portion of a portable label printing machine 301, with the attaching members 385 formed on side frames 390 of the head 302. A plurality of hollow center type rings 303 and a non-type ring 339 at the end of the array of rings are supported by a carrier member 386 between the frame plates 310 and 310' of side frame 390. The type ring assembly 306 comprised of type rings 303*a*–303*h* all on the carrier member 386 are brought together into close contact by pressing the non-type ring 339 in the axial direction. Thus, bar code printing becomes possible.

Figure 17:
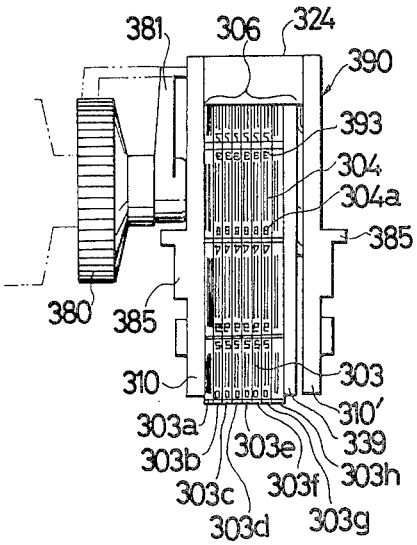
FIG. 17 is a front elevational view of this embodiment of the printing head.
Figure 18:
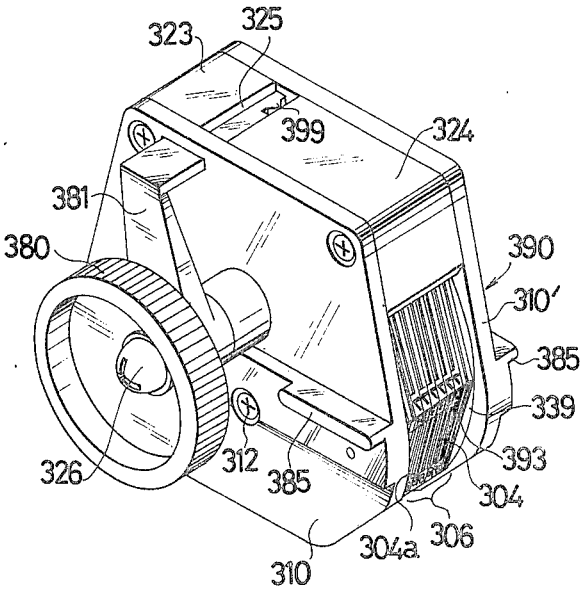
FIG. 18 is a perspective view of this embodiment of the printing head.

In the printing head 302, each type ring 303 is a regular decagon. On all type rings 303, there is a series of ten sequenced types 304*a* carrying numerals from 0 to 9. In each type face also a bar code type 304 that is represented by the respective numerical types 304*a* are respectively provided on the sides of type rings 303. Separate indicating indicia 393 are also disposed on the peripheral sides of the decagonal type ring 303, except on the type rings 303*a*–303*h* as shown in FIG. 17. When the type ring 303 is rotated so that a particular indicating indicium 393 is positioned in the below described sight window 325, the numerical type 304*a* and bar code type 304 that correspond to the visible indicating indicium 393 are positioned in the printing position of printing head 302 as printing types 331.

On the inside of each type ring 303 are formed inner gear teeth 305 which correspond to the respective sides of the decagon.

The non-type ring 339 is circular, as shown in FIG. 26(*a*), and it has inner gear teeth 305 like those formed on the inside walls of type rings 303. The non-type ring 339 is disposed between the type ring 303*h* and the frame plate 310' of side frame 390.

The carrier member 386 is an integral axially extending block, the outside of which is provided with a plurality of sets of resilient engaging pieces 307, arranged side-by-side. The number and spacing of each side of the engaging pieces 307 corresponds to the number of type rings 303*a*–303*h* plus the non-type ring 339. The engaging pieces 307 are resiliently urged, by their own inherent elasticity, radially outwardy. The outer sides of pieces 307 are semi-circularly shaped so as to engage the tooth crests of the inner gear teeth 305 of type rings 303 and non-type ring 339. The breadth of each engaging piece 307 is smaller than the thickness of the type rings 303 and of the non-type ring 339. When the type ring assembly 306 of type rings 303*a*–303*h* and non-type ring 339 is fitted to the carrier member 386, the engaging pieces 307 are caused to engage in the recesses 309 formed between the inner gear teeth 305. Thus, all types 304 and 304*a* of all of the type rings are aligned flat and in the same plane.

Figure 19:
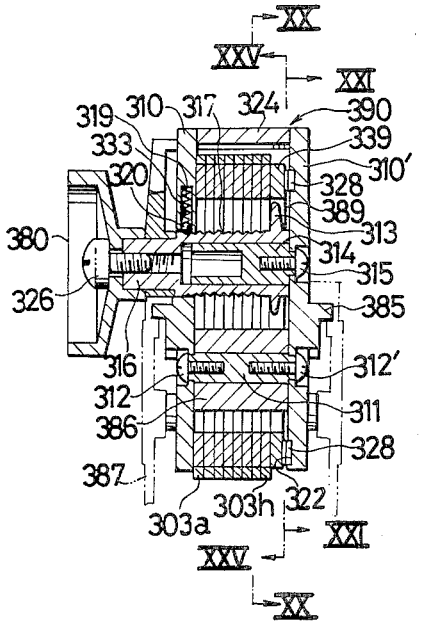
FIG. 19 is a vertical cross-sectional front view of this printing head.
Figure 20:
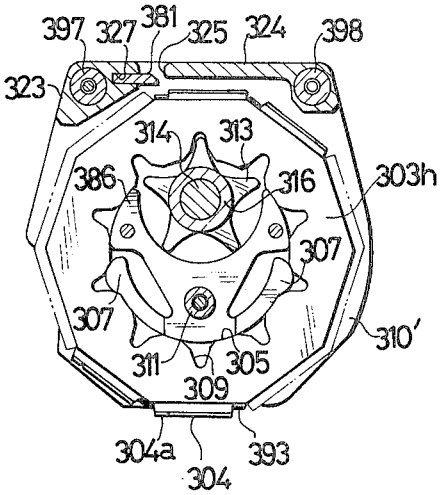
FIG. 20 is a vertical cross-sectional view taken along the line XX—XX in FIG. 19.
Figures 27, 28:
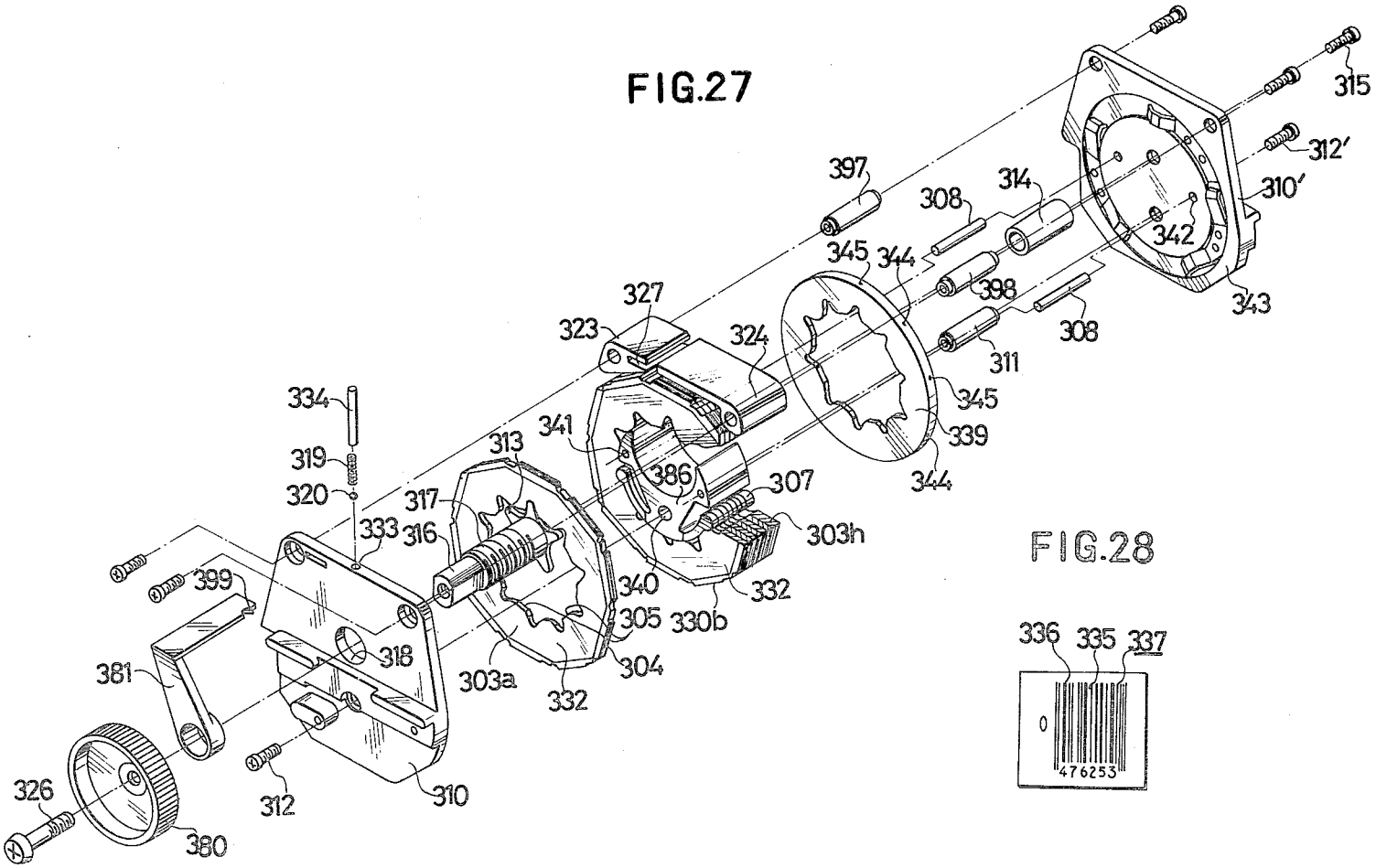
FIG. 27 is an exploded perspective assembly drawing of the parts of the printing head of the third embodiment of the present invention.
FIG. 28 is a plan view of a label on which bar code characters are printed by using the printing head of any embodiment of the present invention.

As shown in FIGS. 19, 20 and 27, the carrier member 386 is provided with a supporting shaft 311 that is inserted into a through hole 340 that passes through the carrier member 386. By means of the supporting shaft 311 and screws 312 and 312′, the carrier member 386 is fixed to the frame plates 310 and 310′.

Other supporting shafts 308 are inserted through correspondingly sized holes 341 passing through the carrier member 386. The opposite ends of the shafts 308 are fitted into the recesses 342 formed on the insides of frame plates 310 and 310′. The rotation of the carrier member 386 is prevented by the shafts 308, 311.

Indicator frames 323 and 324 are also attached to the frame plates 310 and 310′ by the respective shafts 397 and 398 so as to more firmly maintain the space between the frame plates 310 and 310′. Within the frame 390 thus formed, the type rings 303*a*–303*h*, and the non-type ring 339 are supported to be slidable along the axis of the carrier member 386. It is between the indicator frames 232 and 234 that the above described sight window 325 is formed.

The thickness of the carrier member 386 which also is the distance between the frame plates 310 and 310′ of the side frame 390, is made a little larger than the total thickness of the type ring assembly 306 comprised of type rings 303*a*–303*h* plus the non-type ring 339. This thickness difference defines a printing gap 389 which exists when printing is done. The type rings 303 and the non-type ring 339 can be moved along the axis of carrier member 386 for the distance of this printing gap 389.

As shown in FIG. 26, five arcuate recesses 321 are formed in the side surface 338 of the non-type ring 339 near the frame plate 310′. These recesses have the same center, the same radii of curvature, the same arcuate length and they are disposed at regular intervals. Each of the arcute recesses 321 is trapezoidally shaped in cross-section and it arcuately extends past a recess 309 formed between adjoining two gear teeth 305. On the peripheral surface of the non-type ring 339, five star marks 344 are formed at 72° arcuate intervals. Each star mark is at the center point of a recess 321. When a star mark is visible in the sight window 325, it will be described below that the selection of appropriate type 304 for each ring 303 can be accomplished. At the mid-points between adjacent star marks 344, which is also at the space and surface 338 between recesses 321, five double circles 345 are formed. When this mark is visible in the sight window, the type rings 303 are locked in position and the print head is ready for printing.

The cross-section of each arcuate recess 321 which is obtained by cutting along a concentric circumference may be made in any form which enables the free ends 330 of leaf springs 328 on plate 310′ to slide into, along and out of the recess.

Figure 22:
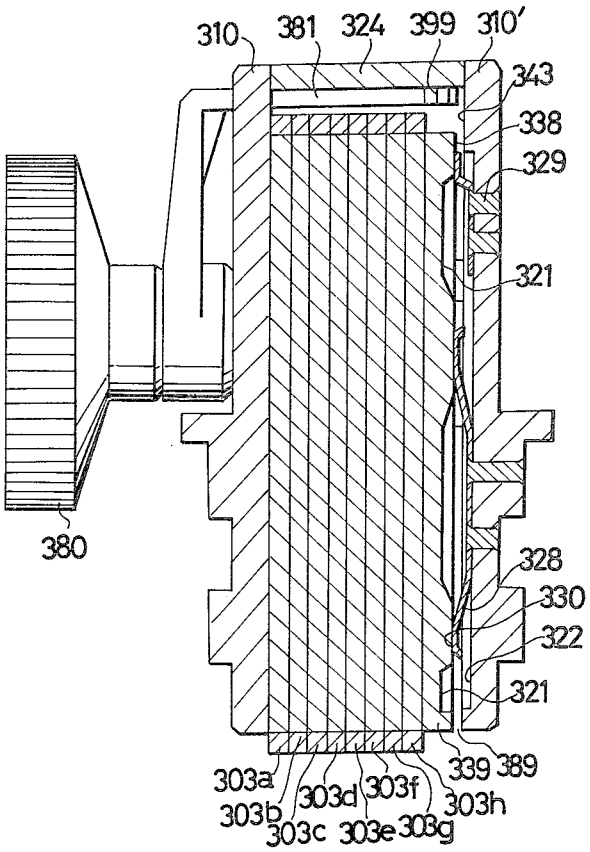
FIG. 22 is a cross-sectional view taken along the line XXII—XXII in FIG. 21, in which a printing gap is increased and rotation gaps are removed during the printing step.
Figure 21:
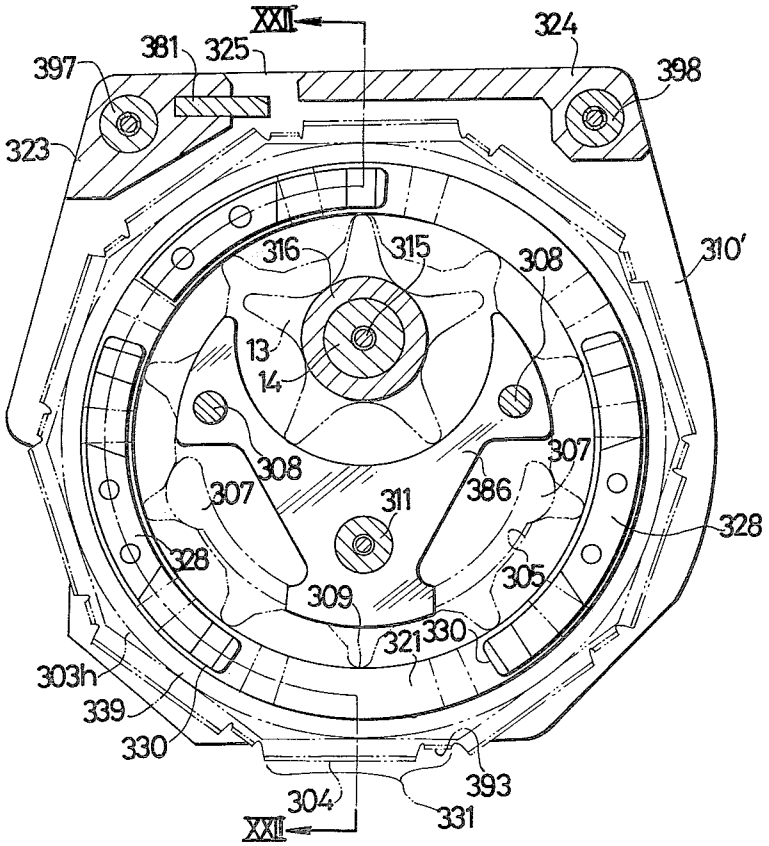
FIG. 21 is an enlarged vertical cross-sectional view taken along the line XXI—XXI in FIG. 19 during a printing step.

On the side of frame plate 310′ facing that side 338 of the non-type ring 339 having circular recesses 321, a circular groove 322 is formed. It has a common center with and the same radius as the arcuate recesses 321. Within the circular groove 322, leaf springs 238 are attached to the frame plate 310′ by rivets 329. As shown in FIGS. 21 and 22, the free ends 330 of leaf springs 328 ride on the side surface 338 of non-type ring 339. Thus, the non-type ring 339 and the type ring assembly 306 are pushed away from the frame plate 310′ by the spring force of leaf springs 328 and the above described printing gap 389 is formed between the side surface 338 of the non-type ring 339 and the inside surface 343 of the frame plate 310′. With reference to FIG. 22, when the non-type ring 339 is biased aside by springs 328, the contact surfaces 332 of the type rings 303*a*–303*h* move into contact with each other. Thus, the bar code types are precisely arrayed side-by-side.

Figure 24:
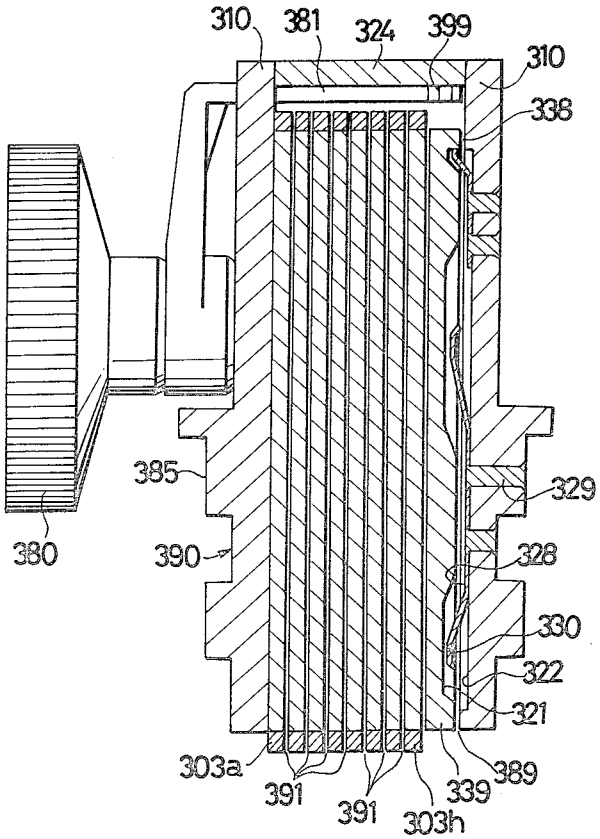
FIG. 24 is a cross-sectional view taken along the line XXIV—XXIV in FIG. 23, in which rotation gaps are formed between type rings.
Figure 23:
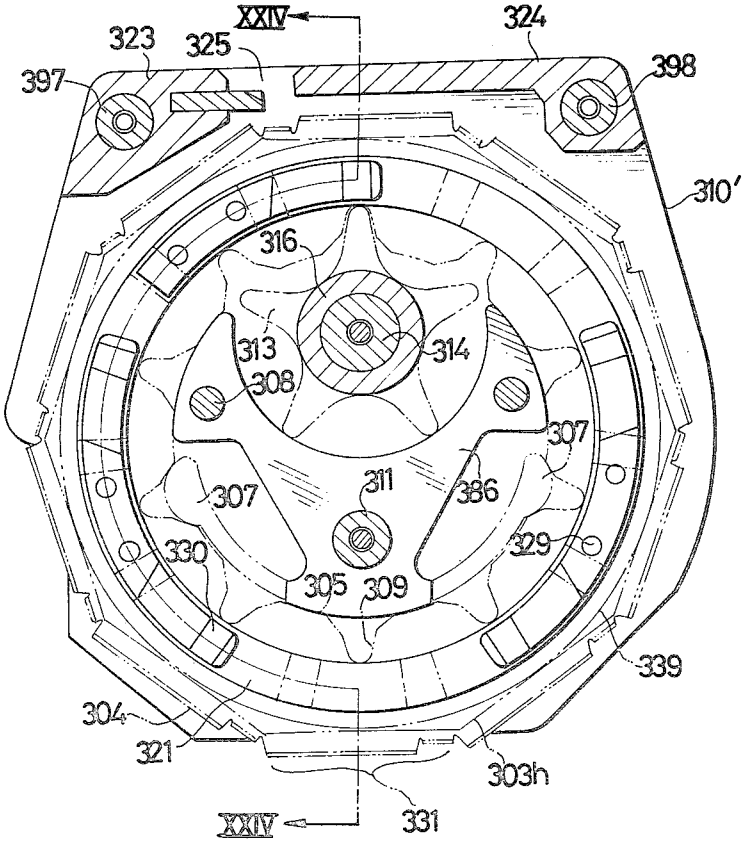
FIG. 23 is an enlarged vertical cross-sectional view like FIG. 21 during a type selecting step.

On the other hand, as shown in FIGS. 23 and 24, when the free ends 330 of leaf springs 328 are received in the arcuate recesses 321 of the non-type ring 339, springs 328 no longer bias ring 339 and rotation gaps 391 form between the type rings 303 and the non-type ring 339, thus loosening the type rings. But in the loosened state shown in FIG. 24, the contact surfaces 332 of the type rings 303*a*–303*h* are separated to form the rotation gaps 391. Therefore, the type rings 303 can be rotated individually without difficulty.

Referring to FIGS. 19 and 27, there is a pinion 313 which is formed integrally with the selector shaft 316. The pinion 313 engages the inner gear teeth 305 in either a type ring 303 or the non-type ring 339. The pinion 313 is positioned in the space between the arc formed by the tooth crests of inner gear teeth 305 of the type rings 303 and of non-type ring 330 and the curved surface formed on the upper portion of the carrier member 386. The tubular selector shaft 316 extends through the same space and extends parallel to the carrier member 386. One end of the selector shaft 316 is held in a bearing hole 318 formed in the frame plate 310, and this end extends outside the frame plate 310. The selector shaft has an unnumbered inner bore that receives a supporting shaft 314 therein. Shaft 314 is attached like a cantilever to the frame plate 310′ with a screw 315. Thus, the selector shaft 316 is slidable in the axial direction and is also rotatable. On the outer surface of the selector shaft 316, a plurality of circular grooves 317 are formed. The grooves have the same spacing apart as the thickness of a type ring 303 and of the non-type ring 339. A steel ball 320 located at the above noted bearing hole 318 is biased toward shaft 316 by a compression spring 319 held within a blind hole 333 formed in the frame plate 310. The upper part of the blind hole 333 is stopped up with a stopper 334. The steel ball 320 at hole 318 is caused to engage in the one of the circular grooves 317 that is then beneath ball 320. By the engagement between the steel ball 320 and one of the circular grooves 317, the free movement of the selector shaft 316 in the axial direction is checked, and it can be held at a selecting position.

On one end of the selector shaft 316, a selector knob 380 is attached by a screw 326. Hence, operation of knob 380 rotates the selector shaft 316 with the pinion 313 and slides the shaft 316 laterally.

Between the selector knob 380 and the frame plate 310, an L-shaped indicating member 381 that indicates the position of the pinion 313 and which thus indicates the type ring then to be adjusted, is attached to the shaft 316 and knob 380 so as to slide axially together with the selector knob 380. The indicating member 381 is slid along and through the sight window 325. Its motion is guided by the guide groove 327 of the indicator frame 325. The pointed end 399 of the indicating member 381 points at an indicating indicium 393 on one of the type rings 303*a*–303*h*. This indication can be observed through the sight window 325. The pointed end 399 is so located that the pinion 313 is in engagement with the recess 309 of the type ring 303 that is indicated by the pointed end 399. Thus, when a type 331 to be printed is decided upon, the pointed end 399 is moved to the corresponding type ring 303 by moving the selector knob 380 laterally along its axis. Then a desired indicating indicium 393 on that type ring is selected by rotating the type ring 303 with the selector knob 380.

Figure 10:
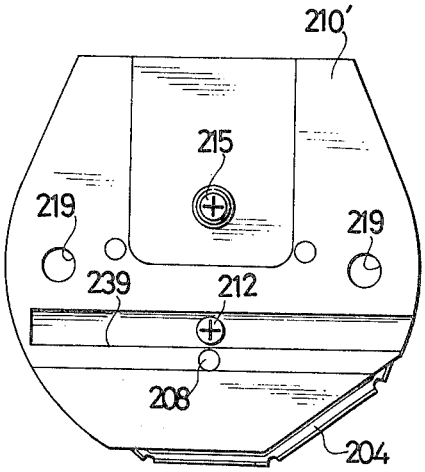
FIG. 10 is a side view of the type ring assembly of FIG. 9.

In the printing state shown in FIGS. 21 and 22, the non-type ring 339 is pushed by the leaf springs 328 so as to form a printing gap 389 between the inside wall 343 of the frame plate 310' and the side surface 338 of the non-type ring 339. At the same time, the rotation gaps 391 between the type rings 303*a*–303*h* are closed, as shown in FIG. 22. Thus, the type ring assembly 306 is tightened up and arcuate recesses 321 of the non-type ring 339 align with printing types as shown in FIG. 10. Further, the types 331 in the lower parts of the type rings 303*a*–303*h* of the printing head 302 are disposed with proper intervals and the bar code types are positioned so as to print precisely. The selector knob 380 is next pushed into the printing head 302 so that the pinion 313 moves into engagement with the non-type ring 339.

In this state, the engaging pieces 307 engage with the recesses 309 of the type rings 303*a*–303*h* so that the types 331 of the type rings 303 are precisely arrayed on the same plane and flat in the printing position. When printing is performed in this state, because the type rings 303*a*–303*h* are pressed together, the light spaces 335 of the bar code 337 printed on a label, as shown in FIG. 28, are always maintained properly to facilitate optical reading.

When a new set of types 331 is to be selected, the non-type ring 339 is rotated for about 36°, covering the angular length of a type 331. Such rotation of ring 339 is accomplished by leaving the selector knob 380 fully inserted, with the pinion 313 in engagement with the non-type ring 339 in the state shown in FIGS. 23 and 24. During the 36° rotation of knob 380, in the sight window 325, the double circle 345 on the non-type ring 339 changes to a star mark 344. Ths mark indicates that type selection can be made. As a result of this rotation of ring 339, the free ends 330 of the leaf springs 328 slide into the recesses 321 of the non-type ring 339 from the side surface 338 thereof. The width of the printing gap 389 is accordingly decreased and the non-type ring 339 is released from the pressure of leaf springs 328. The contact surfaces 332 of the type rings 303*a*–303*h* are separated from each other, forming the rotation gaps 391. Each type ring 303 becomes rotatable. Thus, a simple 36° rotation of ring 339 determines when the type rings are rotatable.

In the next step, the pointed end 399 of the indicating member 381 is moved as described above the point to a type ring 303 to be rotated. A desired indicating indicium 393 is selected by rotating the selector knob 380. This operation is repeated with regard to all type rings to be reset.

After the selection of the type 331, the selector knob 380 is pushed into the printing head 302 so as to set the pointed end 399 to the non-type ring 339. Next the print permission mark, comprised of double circle 345 on ring 339, is moved into the sight window 325 by rotating the selector knob 380 and the non-type 339 with it for about 36°. The free ends 330 of the leaf springs 328 now ride onto the side surface 338 of the non-type ring 339. Thus, the non-type ring 339 is pushed away from the frame plate 310' by the force of leaf springs 328 and the printing gap 389 is formed again. The rotation gaps 391 are closed and the type rings 303*a*–303*h* are brought into close contact. Thus, the printing of the new bar code character 331 becomes possible.

With the above-disclosed embodiment, the close contact and securement together of the type rings and their releasing and selective rotation can be performed merely by operating the selector knob 380.

In a modification of the above embodiment, the non-type ring 339 between the type rings and the frame plate may be omitted so that the type rings are directly pressed together or released for rotation by operating the selector knob.

In a further modification, for example a lever may extend from the non-type ring or from a type ring located outside the frame plate, and the type rings may be pressed together or released by operation of this lever. Other type ring pressing means may be provided so as to press together and release the arrayed type rings by a single operation. In any case, when the light spaces of printed bar code characters are properly set, precise printing of the bar codes can be attained. The indicating indicia may be formed separately from the type rings.

The following advantages can be obtained with all of the foregoing embodiments of printing head.

1. The printing of optically readable bar code characters can be performed through use of a portable label printing machine.
2. Since type rings having bar code types, consisting of dark bars and light spaces, are brought into close contact by using a pressing means, bar code characters of high precision can be always printed.
3. Since the type rings are released to rotate during the selection of types, the type rings can be smoothly rotated and type selection is carried out quickly.
4. The printing head of these embodiments of the present invention are quite suitable for various bar code type printing machines used in store fronts of supermarkets or the like employing a POS system.

Although the present invention has been described in connection with a number of preferred embodiments thereof, many further variations and modifications will now become apparent to those skilled in the art. It is preferred, therefore, that the present invention be limited not by the specific disclosure herein, but only by the appended claims.

What is claimed is:

1. A printing head, which is mountable on a printing machine for selecting and printing indicia on labels, or the like, said printing head comprising:

a plurality of type rings; each said type ring having a periphery and having a plurality of sides around its periphery; each said type ring side carrying a respective printable indicium;

a common rotation support for all said type rings, around which each said type ring is rotatable independently of the other said type rings;

type ring pressing means engageable with said type rings to press said type rings into contact together, thereby eliminating clearance spaces between adjacent said type rings such that an individual said type ring is prohibited from rotation independently of the other said type rings; said type ring pressing means being positionable in a second manner with respect to said type rings so as to stop pressing said type rings together to permit clearance spaces to develop between said type rings, such that said type rings may be independently rotated;

type selector means movable with respect to said type rings along said common support to be in engagement with a selected said type ring, and when said type selector means is in engagement with a said type ring, said type selector means being movable to rotate that said type ring.

2. The printing head of claim 1, further comprising:

a pair of frame plates to which said type ring support is connected; said type rings, when pressed together, having a first total thickness; the spacing between said frame plates being greater than said first thickness.

3. The printing head of claim 2, wherein said type selector means comprises a type selector shaft extending through all said type rings and comprising a type ring engagement element fixed to said type selector shaft;

said selector shaft being axially, longitudinally shiftable along a path joining said frame plates; said engagement element being so shaped that it passes all said type rings as said selector shaft is shifted axially and such that said engagement element is engageable with the said type ring at which said engagement element is positioned when axial shifting of said selector shaft is halted, such that upon rotation of said selector shaft around its axis, said engagement element engages and rotates that said type ring.

4. The printing head of claim 3, further comprising:

a plurality of indicating wheels, with one said indicating wheel for each said type ring; indicia carried on said indicator wheels corresponding to indicium presented and in related placement to the types on each respective type ring, such that upon rotation of said indicating wheel to show any particular indicium at one particular position, the corresponding said type on said type ring carrying that said indicium is at the particular print position; means interconnecting each said indicator wheel with its respective said type ring for rotating them together.

5. The printing head of claim 3, wherein each said type ring has an opening therethrough through which said selector shaft passes; said type ring openings being defined by internal gear means in said type rings; said engagement element being engageable with each said internal gear means in each said type ring.

6. The printing head of claim 5, wherein each said type ring has a type ring array alignment hole extending therethrough along the direction of said selector shaft; all said alignment holes in all said type rings being at the same radial position with reference to said type ring supports; said alignment holes on all said type rings being alignable;

an arranging bar passing into and through the aligned said alignment holes in said type rings for maintaining alignment of said type rings.

7. The printing head of claim 6, wherein there is a common print direction and said type rings are rotated to bring a said type on said type rings to face in said print direction;

a plurality of uniformly angularly spaced said alignment holes being so placed on each said type ring that at every rotative position of every said type ring at which any said type rings has a said type directed in said common print direction, there is a set of said alignment holes that is aligned across all of said type rings.

8. The printing head of claim 6, wherein there is a common print direction and said type rings are rotated to bring a said type on each of said type rings to face in said print direction;

a plurality of uniformly angularly spaced said alignment holes on all said type rings, the same in number on each said type ring as there are said types on that said type ring; all said alignment holes on each said type ring being at the same positions on the respective said type ring such that with any said type on each said type ring being directed in said common print direction, all said alignment holes of all said type rings are aligned.

9. The printing head of claim 7, further comprising a common support plate to which said arranging bar is attached and on which said selector shaft is rotatably supported; said support plate being supported by a said frame plate such that said support plate is axially shiftable along with said selector shaft, while it is not rotatable therewith.

10. The printing head of claim 2, wherein said pressing means is engageable with to press upon one end of said plurality of type rings and said pressing means presses along said support toward the other end of said plurality of type rings.

11. The printing head of claim 10, wherein said pressing means is supported on one said frame plate.

12. The printing head of claim 10, wherein said pressing means comprises a movable type ring pressing element which is adjacent to a said type ring and is movable with respect thereto; a cooperating first pressure element on said type ring pressing element and a cooperating second pressure element on said adjacent type ring; said type ring pressing element being movable along a pathway generally paralleling the plane of said type ring between a first and a spaced away second position;

at said type ring pressing element first position, said first and second pressure elements being in engagement; said first and second pressure elements being shaped such that upon their being in engagement, said adjacent type ring is moved in one direction with respect to a said frame plate and upon said first and second pressure elements being disengaged, said adjacent type ring is moved in the opposite direction with respect to that said frame plate.

13. The printing head of claim 10, wherein said pressing means comprises a bar interposed between one said frame plate and one said type ring; said bar being supported for movement along a pathway generally paralleling the plane of said one type ring between a first and a spaced away second position;

a cooperating first pressure element on said bar and a cooperating second pressure element connected to said one type ring; at said first position of said bar, said first and second pressure elements being in engagement; said first and second pressure elements being shaped such that upon their being in engagement, said one type ring is moved in one direction with respect to the other said frame plate and upon said first and second pressure elements being disengaged, said one type ring is moved in the opposite direction with respect to the other said frame plate.

14. The printing head of claim 13, wherein one of said first and second pressure elements comprises an inclined projection and the other of those said elements comprises a correspondingly inclined recess, such that when said projection and said recess engage, said one type ring is free to move toward said one frame plate, and when said projection is outside said recess, said one type ring is moved by the biasing force exerted by said projecting against said one type ring toward the other said frame plate.

15. The printing head of claim 14, wherein said projection extends from said bar toward said one type ring and said recess is connected with said one type ring.

16. The printing head of claim 10, wherein said pressing means comprises a pressing ring carried on said support and rotatable with respect thereto; said pressing ring being rotatable between a first and a second position;

a cooperating first pressure element on said pressing ring; said pressing ring being adjacent to a said type ring; a cooperating second pressure element on said adjacent type ring and facing toward said first pressure element;

at said pressure ring first position, said first and second pressure element are in engagement; said first and second pressure elements being shaped such that upon their being in engagement, said adjacent type ring is moved in one direction with respect to a said frame plate and upon said first and second pressure elements being disengaged, said adjacent type ring is moved in the opposite direction with respect to that said frame plate.

17. The printing head of claim 16, wherein one of said first and second pressure elements comprises a leaf spring and the other of said first and second pressure elements comprises a recess that is shaped to receive said leaf spring and that is shorter in its angular dimension than the entire length of said ring on which said recess is located.

18. The printing head of claim 17, wherein said leaf spring is on the side of said pressing ring and said recess is on the adjacent side of said adjacent type ring.

19. A printing head, which is mountable on a printing machine for selecting and printing indicia on labels, or the like, said printing head comprising:

a plurality of type rings; each said type ring having a periphery and having a plurality of sides around its said periphery; each said type ring side carrying a respective printable indicium;

a common rotation support for all said type rings, around which each said type ring is rotatable independently of the other said type rings;

type selector means movable with respect to said type rings along said common support for engagement with a selected said type ring, and when said type selector means is in engagement with a said type ring, said type selector means being movable to rotate that said type ring;

a plurality of indicating wheels, with one said indicating wheel for each said type ring; indicia carried on said indicator wheels corresponding to indicium presented and in related placement to the types on each respective type ring, such that upon rotation of said indicating wheel to show any particular indicium at one particular position, the corresponding said type on said type ring carrying that said indicium is at this particular print position; all said indicating wheels being carried on an indicating wheel common support;

an indicating wheel selector means movable with respect to said indicating wheels along said indicating wheel common support to be in engagement with a selected said indicating wheel and when said indicating wheel selector means is in engagement with a selected said indicating wheel, that said selector means is movable to rotate that said indicating wheel;

said indicating wheel selector means and said type selector means being connected together such that movement of said type selector means along said type ring common support correspondingly moves said indicating wheel selector means; said indicating wheels being so positioned with respect to their respective said type rings that when said type selector means is in engagement with a said type ring, said indicating wheel selector means is in engagement with the respective said indicating wheel;

said type selector means and said indicating wheel selector means also being so connected together that rotation of a said type ring correspondingly rotates the respective said indicating wheel.

20. The printing head of claim 19, wherein said type selector means comprises a type selector shaft extending through all said type rings and comprising a type ring engagement element fixed to said type selector shaft;

said selector shaft being axially, longitudinally shiftable along a path joining said frame plates; said engagement element being so shaped that it passes all said type rings as said selector shaft it shifted axially and such that said engagement element is engageable with the said type ring at which said engagement element is positioned when axial shifting of said selector shaft is halted, such that upon rotation of said selector shaft around its axis, said engagement element engages and rotates that said type ring;

said indicating wheel selector means comprising an indicating wheel selector shaft extending through all said indicating wheels and comprising an indicating wheel engagement element fixed to said indicating wheel selector shaft;

said indicating wheel selector shaft being axially, longitudinally shiftable along a path joining said frame plates; said indicating wheel engagement element being so shaped that it passes said indicating wheel as said indicating wheel selector shaft is shifted axially and such that said indicating wheel engagement element is engageable with the said indicating wheel at which said indicating wheel engagement element is positioned when axial shifting of said indicating wheel selector shaft is halted, such that upon rotation of said indicating wheel selector shaft around its axis, said indicating wheel engagement element engages and rotates that said indicating wheel;

gear means joining said indicating wheel selector shaft and said type selector shaft for corresponding rotation together.

21. The printing head of claim 20, further comprising a sight window extending across aid plurality of indicating wheels to enable observation of said indicating wheels.

22. The printing head of claim 21, further comprising an indicator element attached to said selector shafts for movement across said plurality of indicating wheels and located in said sight window and having an indicator aligned with said indicating wheel engagement element.

* * * * *